US009970622B2

(12) United States Patent
Helbig et al.

(10) Patent No.: US 9,970,622 B2
(45) Date of Patent: May 15, 2018

(54) LIGHTING DEVICE

(71) Applicant: OSRAM GmbH, Munich (DE)

(72) Inventors: Philipp Helbig, Heidenheim (DE); Peter Frey, Heidenheim (DE); Peter Helbig, Sontheim an der Brenz (DE); Thomas Feil, Gschwend (DE)

(73) Assignee: OSRAM GMBH, Munich (DE)

( * ) Notice: Subject to any disclaimer, the term of this patent is extended or adjusted under 35 U.S.C. 154(b) by 39 days.

(21) Appl. No.: 15/001,307

(22) Filed: Jan. 20, 2016

(65) Prior Publication Data

US 2016/0215948 A1 Jul. 28, 2016

(30) Foreign Application Priority Data

Jan. 23, 2015 (DE) ..... 10 2015 201 153

(51) Int. Cl.

| | |
|---|---|
| ***F21S 41/19*** | (2018.01) |
| ***F21S 41/141*** | (2018.01) |
| ***F21S 45/47*** | (2018.01) |
| ***F21S 8/10*** | (2006.01) |

(52) U.S. Cl.

CPC ..... *F21S 48/212* (2013.01); *F21S 48/215* (2013.01); *F21S 48/328* (2013.01)

(58) Field of Classification Search

CPC ..... F21S 48/215; F21S 48/328; F21S 48/212
See application file for complete search history.

(56) References Cited

U.S. PATENT DOCUMENTS

| | | | | |
|---|---|---|---|---|
| 4,992,704 | A * | 2/1991 | Stinson | H05B 33/0821 313/303 |
| 2001/0030866 | A1* | 10/2001 | Hochstein | F21S 48/215 362/294 |
| 2005/0067931 | A1* | 3/2005 | Coushaine | F21K 9/00 313/46 |
| 2008/0117647 | A1 | 5/2008 | Behr et al. | |
| 2009/0045933 | A1* | 2/2009 | Smith | B60Q 1/18 340/468 |
| 2010/0314985 | A1* | 12/2010 | Premysler | F21V 29/402 313/46 |
| 2013/0329444 | A1* | 12/2013 | Oh | F21V 21/00 362/543 |

FOREIGN PATENT DOCUMENTS

| | | | |
|---|---|---|---|
| DE | 102004062990 | A1 | 7/2006 |
| DE | 102011085655 | A1 | 5/2013 |
| DE | 202014002809 | U1 | 4/2014 |
| WO | 2013079302 | A1 | 6/2013 |

OTHER PUBLICATIONS

German Search Report based on Application No. 10 2015 201 153.4 (8 Pages) dated Aug. 24, 2015.

* cited by examiner

*Primary Examiner* — William N Harris
(74) *Attorney, Agent, or Firm* — Viering, Jentschura & Partner mbB

(57) ABSTRACT

A lighting device may include a semiconductor light source arrangement, a heat sink for cooling the semiconductor light source arrangement, electrical connections for supplying power to the semiconductor light source arrangement, and a holding means. The holding means is in the form of a plastic part, at least the electrical connections and the heat sink each being embedded in the plastic material of said plastic part at least in sections.

6 Claims, 2 Drawing Sheets

LIGHTING DEVICE

CROSS-REFERENCE TO RELATED APPLICATION

This application claims priority to German Patent Application Serial No. 10 2015 201 153.4, which was filed Jan. 23, 2015, and is incorporated herein by reference in its entirety.

TECHNICAL FIELD

Various embodiments relate generally to a lighting device, and to a method for producing a lighting device.

BACKGROUND

A lighting device is disclosed, for example, in WO 2013/079302 A1. Said document describes a lighting device for a motor vehicle headlamp which has a semiconductor light source arrangement, a housing, a heat sink for cooling the semiconductor light source arrangement, and an electrical connection element for supplying power to the semiconductor light source arrangement.

SUMMARY

A lighting device may include a semiconductor light source arrangement, a heat sink for cooling the semiconductor light source arrangement, electrical connections for supplying power to the semiconductor light source arrangement, and a holding means. The holding means is in the form of a plastic part, at least the electrical connections and the heat sink each being embedded in the plastic material of said plastic part at least in sections.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
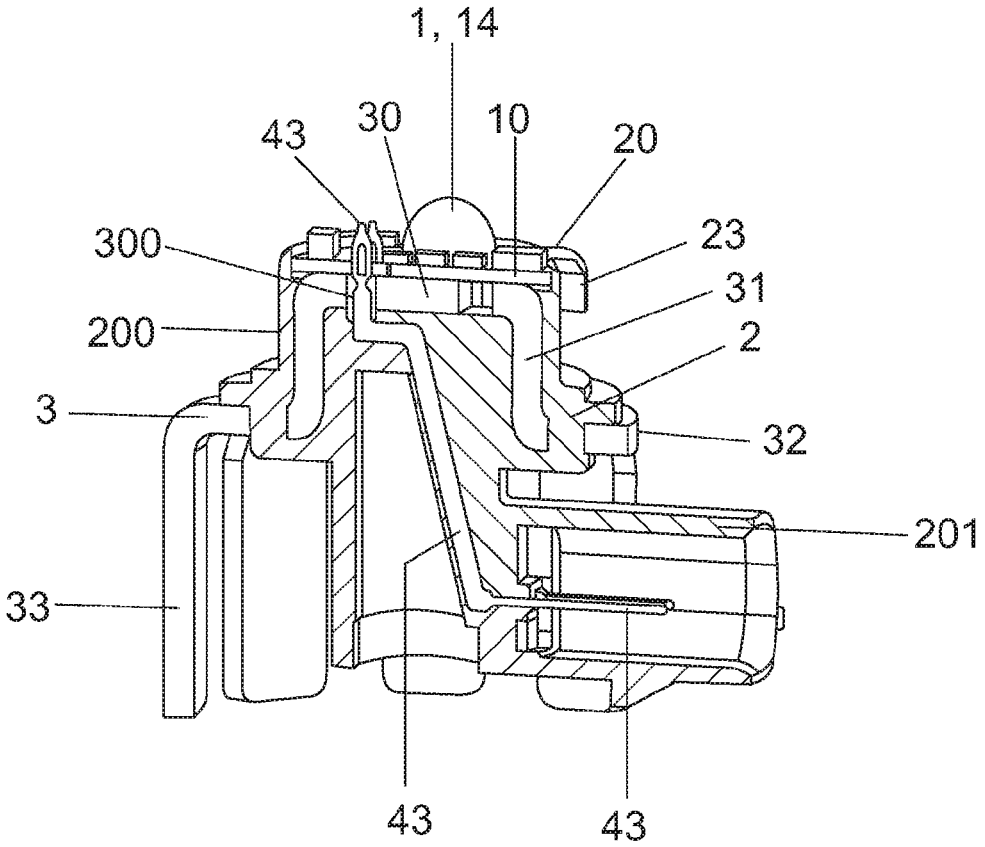
FIG. 1 shows a cross section through a lighting device according to various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a lighting device having a simplified structure, and specify a production method for said lighting device.

The lighting device according to various embodiments has a semiconductor light source arrangement, a heat sink for cooling the semiconductor light source arrangement, electrical connections for supplying power to the semiconductor light source arrangement, and a holding means. According to various embodiments, the holding means is in the form of a plastic part, at least the electrical connections and the heat sink each being embedded in the plastic material of said plastic part at least in sections.

The abovementioned structure of the lighting device according to various embodiments may allow a cost-effective, simple and compact design since at least the electrical connections and the heat sink can be fixed in a common holding means. This holding means is produced in a simple manner by means of a plastic injection-molding process.

The semiconductor light source arrangement may be arranged on a support. As a result, the semiconductor light source arrangement can be manufactured as an independent module and then installed into the lighting device according to various embodiments.

The support may be embedded in the plastic material of the holding means at least in sections in order to be able to fix as many components of the lighting device according to various embodiments as possible in the holding means by a plastic injection-molding process and, as a result, to ensure a correspondingly simple design of the lighting device according to various embodiments.

However, as an alternative, the support can also be arranged in a receptacle in the holding means with a clamping fit or can be held in some other way or can even be in the form of a constituent part of the heat sink.

The support for the semiconductor light source arrangement may be thermally coupled to the heat sink of the lighting device according to various embodiments in order to be able to dissipate the heat which is generated by the semiconductor light source arrangement to the surrounding area by means of the heat sink. To this end, the support may be arranged on a surface of the heat sink in order to ensure contact between the support and the heat sink over a large surface area and therefore to ensure good thermal coupling.

The support for the semiconductor light source arrangement may be in the form of a mounting board. As a result, the components of the semiconductor light source arrangement can be mounted on a surface of the mounting board in a simple manner and can be electrically conductively connected by conductor tracks. However, as an alternative, the support can also be in the form of a leadframe in order to achieve the same effects. In the case of a support which is in the form of a leadframe, the leadframe may be in the form of a constituent part of the heat sink.

The semiconductor light source arrangement of the lighting device according to various embodiments may include at least one semiconductor light source which is arranged on the support. In addition to the semiconductor light source arrangement, an electronics system for operating the semiconductor light source arrangement may be arranged on the support in order to be able to operate the lighting device from a voltage source, for example from the on-board electrical system voltage of a motor vehicle, without further operating means.

The lighting device according to various embodiments may be in the form of an LED (light emitting diode) retrofit and intended for motor vehicle applications. The lighting device according to various embodiments may be compatible with incandescent lamps which are used as rear lights, brake lights, indicator lights, navigation lights or daytime running lights in motor vehicles.

According to various embodiments, the method for producing the lighting device according to various embodiments includes processes and during the course of said processes the electrical connections and the heat sink of the lighting device are inserted into a mold of a plastic injection-molding die and plastic material is injected around the electrical connections and the heat sink so that the plastic material, after solidifying, forms a holding means, the electrical connections and the heat sink being fixed in the material of said holding means.

In addition to the electrical connections and the heat sink, a support for the semiconductor light source arrangement may be inserted into the mold of the plastic injection-molding die and encapsulated with plastic material in order to fix as many components of the lighting device according to various embodiments as possible in a common holding means by means of a plastic injection-molding process.

Figure 2:
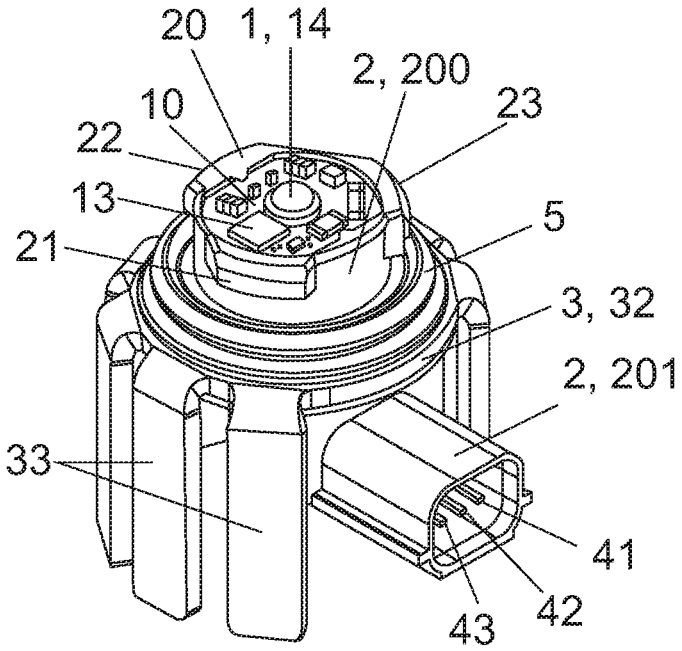
FIG. 2 shows a perspective view of the lighting device depicted in FIG. 1.

FIG. 1 and FIG. 2 schematically show a lighting device according to various embodiments.

The lighting device according to various embodiments has a semiconductor light source arrangement 1 which is arranged on a support 10, a heat sink 3 for cooling the semiconductor light source arrangement 1, three electrical connections 41, 42, 43 for supplying power to the semiconductor light source arrangement 1, and a common holding means 2 for the electrical connections 41, 42, 43 and the heat sink 3. The lighting device according to various embodiments is provided for use in motor vehicles for generating the brake light and rear light.

The semiconductor light source arrangement 1 may include five light-emitting diodes which, together with an electronics system 13 for operating the light-emitting diodes and a primary optical system 14 for the light which is emitted by the light-emitting diodes, are arranged on a mounting board 10. The mounting board 10 serves as a common support 10 for the light-emitting diodes of the semiconductor light source arrangement 1 and the electronics system 13 and also the optical system 14. The light-emitting diodes and the electronics system 13 are mounted on a surface of the mounting board 10 and are electrically connected to one another by conductor tracks. The electronics system 13 is in the form of a driver circuit, e.g. in the form of a so-called linear driver, that is to say is in the form of a linear voltage controller. The five light-emitting diodes emit red light during operation. Four light-emitting diodes are arranged at the corners of an imaginary square on the surface of the mounting board 10. The fifth light-emitting diode is arranged in the center of this imaginary square. The light-emitting diodes are covered by a semi-spherical, transparent dome 14 which is arranged on the surface of the mounting board 10 and serves as a primary optical system and also for protecting the light-emitting diodes. The light-emitting diodes which are arranged at the corners of the imaginary square together serve for generating the brake light. The central light-emitting diode serves for generating the tail light.

The holding means 2 is unipartite, in the form of a plastic injection-molded part and has a cylindrical holding section 200 and also a holding section 201 which is in the form of a socket in which ends of the electrical connections 41, 42, 43, which ends are in the form of contact pins, are arranged. The holding means 2 is composed of polyamides (PA) for example.

The cylindrical holding section 200 has an end face with an end surface 20 which is of planar design, is in the shape of an annular disk and serves as a reference plane for the orientation of the light-emitting diodes of the semiconductor light source arrangement 1 with respect to the holding means 2 and with respect to the optical axis of the holder of a motor vehicle lamp into which the lighting device is inserted. Three locking elements 21, 22, 23 which project radially from the outer casing surface of the cylindrical holding section 200 and form a bayonet fitting with correspondingly shaped mating pieces of a holder of the motor vehicle lamp are arranged along the outer circumference of the end surface 20 which is in the shape of an annular disk. In order to activate the bayonet fitting, the lighting device is plugged into the holder of the motor vehicle lamp and then rotated about the cylinder axis of the cylindrical holding section 200 in the clockwise direction. In order to limit the abovementioned rotary movement, a locking element 23 has a stop which fits in the holder or mounting opening of the motor vehicle lamp in accordance with the bayonet fitting. Within the cylindrical holding section 200, the mounting board 10 is arranged with the semiconductor light source arrangement 1 mounted on it. The mounting board 10 is arranged perpendicular to the cylinder axis of the cylindrical holding section 200. The cylindrical holding section 200 forms a receptacle for a sealing ring 5 on its outer casing surface, said sealing ring fitting in the holder of a motor vehicle headlamp after the lighting device is mounted.

The holding section 201 which is in the form of a socket is arranged in a manner angled in relation to the cylinder axis of the cylindrical holding section 200. The ends of the electrical connections 41, 42, 43, which ends are in the form of contact pins, are arranged in one plane, perpendicular to the cylinder axis of the cylindrical holding section 200, within the socket 201. The electrical connections 41, 42, 43 are composed of metal and are embedded in the plastic material of the holding means 2, which is in the form of a plastic injection-molded part, in sections, and therefore the ends of said electrical connections are freely accessible for the purpose of making electrical contact. A first end of the electrical connections 41, 42, 43 is in each case in the form of a contact pin and arranged within the socket 201. A second end of the electrical connections 41, 42, 43 is in each case routed through an aperture in the mounting board 10 and forms an electrical contact-connection with a conductor track on the mounting board 10 in order to establish an electrical connection to the semiconductor light source arrangement 1.

The heat sink 3 has a hollow-cylindrical heat sink section 31 which is embedded in the plastic material of the holding means 2 in the region of the cylindrical holding section 200 and, on its side which faces the end surface 20 of the cylindrical holding section 200, forms a planar surface 30 for the mounting board 10 of the semiconductor light source arrangement 1. The cylinder axis of the hollow-cylindrical heat sink section 31 is identical to the cylinder axis of the cylindrical holding section 201. The surface 30 of the heat sink 3, which surface serves as a bearing surface for the mounting board 10, is arranged perpendicular to the cylinder axis of the hollow-cylindrical heat sink section 31 and is adhesively bonded to the mounting board 10 of the semiconductor light source arrangement 1 with electrically insulating, thermally conductive adhesive (also called thermally conductive paste in the text which follows). The surface 30 of the hollow-cylindrical heat sink section 31 has an aperture 300 through which in each case a second end of the three electrical connections 41, 42, 43 is routed. The second ends of the three electrical connections 41, 42, 43 form a press fit with the mounting board 10. However, as an alternative or in addition to the press fit, the second ends of the electrical connections 41, 42, 43 can in each case also be connected to an electrical contact of the mounting board 10 by soldering.

The heat sink 3 also has a heat sink section 32 which is in the shape of an annular disk, is integrally formed on the hollow-cylindrical heat sink section 31 and of which the ring axis coincides with the cylinder axis of the hollow-cylindrical heat sink section 31. Cooling ribs 33 which are arranged along the circumference of the heat sink section 32 which is in the shape of an annular disk are integrally formed on said heat sink section. The cooling ribs 33 are each angled away from the heat sink section 32, which is in the shape of an annular disk, through an angle of 90 degrees and each extend parallel to the ring axis of the heat sink section 32 which is in the shape of an annular disk. The outer edge of the heat sink section 32 which is in the shape of an annular disk and the cooling ribs 33 which are integrally formed on said heat sink section project out of the plastic material of the holding means 2 or of the cylindrical holding section 200. The heat sink 3 is composed of metal, for example from sheet stainless steel, and is integrally formed in the form of a deep-drawn bent part. The cooling ribs 33 form a cutout through which the holding section 201 which is in the form of a socket extends.

In order to produce the lighting device according to various embodiments, which lighting device is schematically depicted in FIG. 1 and FIG. 2, the electrical connections 41, 42, 43 which are in the form of contact pins are inserted into a mold half of a plastic injection-molding die, so that the ends of said electrical connections in each case project out of the mold. The heat sink 3 is likewise inserted into this mold half, so that parts of the hollow-cylindrical section 31 of said heat sink and that section 32 of said heat sink which is in the shape of an annular disk are arranged in the mold half. The mold is then closed and plastic material is injected around those sections of the electrical connections 41, 42, 43 which are surrounded by the mold and around those parts of the heat sink sections 31, 32 which are arranged in the mold. The holding means 2 and, for example, the cylindrical holding section 200 of said holding means and also that holding section 201 of said holding means which is in the form of a socket are also formed by means of the mold of the plastic injection-molding die after the plastic material has been filled and then left to solidify. A thermally conductive paste is applied to that surface 30 of the heat sink 3 which projects out of the plastic material of the holding means 2, and the mounting board 10 which is provided with the semiconductor light source arrangement 1 and the optical system 14 and also the electronics system 13 is fixed on the surface 30 of the heat sink 3 by a press fit with the second ends of the contact pins 41, 42, 43. In addition, the mounting board 10 can be connected to the cylindrical holding section 200 by means of hot-stamping.

Various embodiments are not restricted to the embodiments described in detail above. For example, the mounting board 10 with the semiconductor light source arrangement 1 and the optical system 14 and also the electronics system 13 mounted on it can likewise be embedded and fixed in the plastic material of the holding means 2, e.g. in the region of the cylindrical holding section 200, by means of plastic injection-molding technology. In addition, the holding section 201 which is in the form of a socket can also have a different shape. By way of example, said holding section can extend parallel to the cylinder axis of the cylindrical holding section 200 and those ends of the contact pins 41, 42, 43 which are arranged in the socket 201 can likewise extend parallel to the cylinder axis of the cylindrical holding section 200.

Furthermore, the holding means 2 can be in the form of a plastic injection-molded part which has been produced by means of a multistage plastic injection-molding process. By way of example, the electrical connections 41, 42, 43 can be inserted into a first injection mold and encapsulated with plastic during a first stage of the plastic injection-molding process, so that the holding section 201 which is in the form of a socket, together with the electrical connections 41, 42, 43 which are fixed in said holding section, is formed during the first method process. The holding section 201 which is in the form of a socket, together with the electrical connections 41, 42, 43 which are fixed in it and together with the heat sink 3, could then be inserted into a second injection mold and encapsulated with plastic in order to form the complete holding means 2 with the additional, cylindrical holding section 200. This two-stage plastic injection-molding process has the advantage that the holding section 201 which is in the form of a socket and the cylindrical holding section 200 can be composed of different plastic materials.

Furthermore, the support 10, with the semiconductor light source arrangement 1 and electronics system 13 and optical system 14 positioned on it could also be embedded into the plastic material of the holding means in sections during the abovementioned second method process or else by means of a third method process of the plastic injection-molding process for example.

The heat sink of the lighting device according to various embodiments can further have a heat sink section which is composed of a phase-changing material which changes its state of aggregation when it is heated. The heat sink section which is composed of phase-changing material is, for example, completely incorporated in the plastic material of the holding means and changes its state of aggregation from, for example, solid to liquid when it is heated, and back to the solid state again when it is cooled.

In addition, the support 10 can also be in the form of a leadframe instead of in the form of a mounting board, and this leadframe can furthermore be in the form of a constituent part of the heat sink 3. The electrical connections 41, 42, 43 can likewise be in the form of a constituent part of the leadframe. Furthermore, the components of the electronics system 13 can be soldered directly onto the leadframe. Parts of the heat sink 3 or of the leadframe can be provided with a metallic finish, for example by means of nickel-plating or gold-plating or by using sheet brass or bronze.

The heat sink 3, the leadframe or the mounting board 10 can further have mechanical reference elements in order to determine adjustment of the spatial position of the semiconductor light source arrangement 1 with respect to the locking elements 21, 22, 23 and therefore also to determine the spatial position of the semiconductor light source arrangement 1 with respect to a lamp holder in the motor vehicle, into which lamp holder the lighting device is inserted.

In addition, the holding means 2 can be composed of plastic material having a high degree of thermal conductivity in order to assist the cooling function of the heat sink 3.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting device, comprising:

a semiconductor light source arrangement;

a heat sink for cooling the semiconductor light source arrangement;

electrical connections for supplying power to the semiconductor light source arrangement; and a holding means;

wherein the semiconductor light source arrangement is arranged on a support in the form of a mounting board;

wherein the holding means is in the form of a plastic part, at least the electrical connections and the heat sink each being embedded in the plastic material of said plastic part at least in sections;

wherein the holding means comprise a cylindrical holding section and a holding section which is in the form of a socket;

wherein said cylindrical holding section has an end face with an end surface which is of planar design and in the shape of an annular disk, and wherein three locking elements project radially from an outer casing surface of the cylindrical holding section and are arranged along an outer circumference of said end surface and form a bayonet fitting;

wherein the heat sink has a hollow cylindrical heat sink section being embedded in the plastic material of said plastic part in the region of the cylindrical holding section and forming a planar surface for the mounting board;

wherein the heat sink has a heat sink section in the shape of an annular disk that is integrally formed on said hollow-cylindrical heat sink section;

wherein cooling ribs are arranged along a circumference of the heat sink section in the shape of an annular disk and are each angled away from said heat sink section in the shape of an annular disk through an angle of 90 degrees such that each extend parallel to a ring axis of the heat sink section in the form of an annular disk, and wherein the mounting board is fixed on the planar surface of said hollow-cylindrical heat sink section and is arranged within the cylindrical holding section perpendicular to a cylinder axis of the cylindrical holding section and is embedded in the plastic material of the holding means at least in sections.

2. The lighting device of claim 1, wherein, in addition to the semiconductor light source arrangement, an electronics system for operating the semiconductor light source arrangement is arranged on the support.

3. A lighting device, comprising:

at least one semiconductor light source, wherein the at least one semiconductor light source is arranged on a support in the form of a mounting board;

a heat sink configured to cool the semiconductor light source;

electrical connections configured to supply power to the at least one semiconductor light source; and a holding structure;

wherein the holding structure comprises a plastic part;

wherein at least the electrical connections and the heat sink each are at least partially embedded in the plastic material of the plastic part;

wherein the holding structure comprises a cylindrical holding section and a holding section which is in the form of a socket;

wherein said cylindrical holding section has an end face with an end surface which is of planar design and in the shape of an annular disk, and wherein three locking elements project radially from an outer casing surface of the cylindrical holding section and are arranged along an outer circumference of said end surface and forming a bayonet fitting;

wherein the heat sink has a hollow cylindrical heat sink section being embedded in the plastic material of said plastic part in the region of the cylindrical holding section and forming a planar surface for the mounting board;

wherein the heat sink has a heat sink section in the shape of an annular disk and is integrally formed on said hollow-cylindrical heat sink section;

wherein cooling ribs are arranged along the circumference of the heat sink section in the shape of an annular disk and are each angled away from said heat sink section in the shape of an annular disk through an angle 90 of degrees such that each extend parallel to a ring axis of the heat sink section in the form of an annular disk, wherein the mounting board is fixed on the planar surface of said hollow-cylindrical heat sink and is arranged within the cylindrical holding section perpendicular to a cylinder axis of the cylindrical holding section and is embedded in the plastic material of the holding structure at least in sections.

4. The lighting device of claim 3, wherein, in addition to the at least one semiconductor light source, an electronics system for operating the at least one semiconductor light source is arranged on the support.

5. The lighting device of claim 3, wherein the cooling ribs form a cutout through which the holding section which is in the form of a socket extends.

6. The lighting device of claim 1, wherein the cooling ribs form a cutout through which the holding section which is in the form of a socket extends.

* * * * *